United States Patent [19]

Hanson

[11] 4,014,506

[45] Mar. 29, 1977

[54] SUPPORT COLLAR ASSEMBLY FOR FLOWER POTS AND THE LIKE

[75] Inventor: Jack D. Hanson, Garden Grove, Calif.

[73] Assignee: Hanson House, Inc., Long Beach, Calif.

[22] Filed: Apr. 25, 1975

[21] Appl. No.: 571,641

[52] U.S. Cl. ..... 248/311.1; 248/318

[51] Int. Cl.[2] ..... A47K 1/08

[58] Field of Search ..... 47/34.4, 34.7, 35, 38, 47/38.1, 38.10; 248/27.8, 38, 40, 44, 309, 311, 312, 314, 315, 318, 310; D6/113, 137, 182, 183

[56] References Cited

UNITED STATES PATENTS

| | | | |
|---|---|---|---|
| 559,200 | 4/1896 | Parmley | 47/35 UX |
| 770,738 | 9/1904 | Chessman | 248/318 |
| 1,095,504 | 5/1914 | Jannoch | 47/35 X |
| 1,331,680 | 2/1920 | Sherwood | 248/318 |
| 1,369,965 | 3/1921 | Comstock | 47/35 |
| 2,492,152 | 12/1949 | Hollowell | 248/312 X |
| 3,284,039 | 11/1966 | Brunner | 248/318 X |
| 3,430,349 | 3/1969 | Bunton et al. | 248/38 X |

OTHER PUBLICATIONS

Popular Mechanics, "Home Problems," July 1971, p. 137.

*Primary Examiner*—Lawrence J. Staab
*Attorney, Agent, or Firm*—I. Morley Drucker

[57] ABSTRACT

This invention is directed to a novel support collar assembly which is designed, primarily, to fill a need for a simple, reliable and economical way of suspending and supporting standard flower pots, and the like, within any one of a series of larger-diametered containers, or within deeper (i.e., taller) containers.

10 Claims, 5 Drawing Figures

SUPPORT COLLAR ASSEMBLY FOR FLOWER POTS AND THE LIKE

The support collar assembly comprises, in combination, a support collar, designed to be attached below the outer marginal flange of the flower pot, and a plurality of pivotable hanger assemblies designed to be attached to the support collar.

Each pivotable hanger assembly consists of a mounting means, adapted to pivotally engage the support collar, and a hanger element extending upwardly and laterally outwardly, with respect to the support collar. The hanger element, thus formed, is cantilevered with respect to the flower pot and includes preferably, an integrally formed rigid support arm which is designed to overlie and clamp to the upper horizontal edge of the larger diameter container. Preferably, the mounting means, is loosely mounted to the support collar prior to actual use, thereby enabling the hanger assembly capable of manual movement along the circumference of the support collar to a predetermined position. When the flower pot is in the suspended position, the mounting means of the hanger assembly would become firmly secured to the support collar.

The hanger element is, preferably, an integrally formed portion of the mounting means, and because of the pivotal mounting thereof with respect to the support collar, the support arm is free to rotate in a generally horizontal plane.

By attaching a series of hanger assemblies about the circumference of the support collar, and by angularly adjusting the position of the respective support arms to overly the upper edge of the given larger diameter container, the support collar assembly can be used to support a given flower pot within any one of a variety of larger or deeper containers.

The invention is useful to both amateur and professional plant enthusiasts.

BACKGROUND OF THE INVENTION

Support collar assemblies in which support collars are attached below the circumferential flange of a container, such as a flower pot, have been known now for sometime. An example of this type of hanger is described in U.S. Pat. No. 2,530,456 issued to R. M. Fracchia on Nov. 21, 1950 and entitled "COLLAR FOR HANGING FLOWER POTS."

The present support collar assembly is not particularly designed as a means of suspending flower pots or the like from some overhead structure, as in Fracchia, but rather is designed to enable standard flower pots to be hung, and stably supported, within and by means of larger containers of varying sizes. The present support collar assembly involves novel features of construction, and advances in the art.

SUMMARY OF THE INVENTION

The invention relates to a support collar assembly comprising, in combination, a generally circular support collar, which is secured to a flower pot just below its outer marginal flange, and a plurality of hanger assemblies affixed thereto having as their primary function the suspension of a flower pot within any one of a series of larger diameter containers.

The support collar is preferably split vertically at one section and is preferably entirely made of a resilient grade of steel, so that the support collar can be releasably adjusted, manually, to tightly engage the body of the flower pot.

The hanger assembly consists of a mounting means which is designed to be pivotally attached to the support collar and a hanger element attached to the mounting means, the hanger element extending upwardly and outwardly with respect to the support collar, and including a support arm for suspending the flower pot within a larger container.

In the preferred embodiment, the hanger assembly is formed from a unitary wire rod wherein its lower portion is bent into a ring-shaped hook, which hook is referred to herein, and in the claims, as the mounting means. A hanger element is provided as an extension to the mounting means and consists of a portion of wire rod extending generally vertically upwardly from the mounting means (that upwardly extended portion being called the extension arm) and an integrally formed support arm connected to the upper end of the extension arm. The support arm is bent to a generally horizontal cantilevered position that is approximately at right angles with the generally vertically extending extension arm. The free end of the support arm is bent laterally downwardly into a hook portion which enables the generally horizontal support arm to be more stably mounted onto the lip of the outer container into which the inner pot is placed.

The mounting means is designed to be slightly oversized or loose fitting with respect to the support collar so that the hanger assembly can be both rotated approximately 180° with respect to the support collar and can be easily moved along the support collar circumference when the flower pot is not in the suspended and supported position. The rotatability of the hanger assembly enables rotation of the support arm to a particular position wherein it can, optimally, suspend the inner flower pot to any of varying sized larger diameter containers. In this manner, a plurality of hanger assemblies, of a single form and size, attached to the support collar, can be used to stably mount one flanged container within one of a number of larger containers.

Though the hanger element and mounting means have been described above as being integrally formed from one wire rod, the two elements can be made as separate members and then affixed to each other.

DETAILED DESCRIPTION OF THE INVENTION

Figure 1:
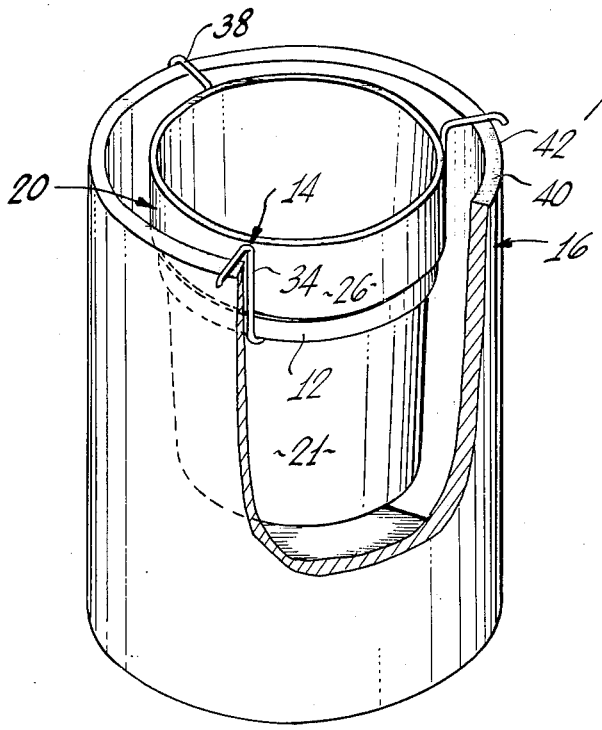
FIG. 1 is a perspective view of a typical flanged flower pot or the like supported within an outer larger container by the typical support collar assembly of this invention.

The support collar assembly 10 of this invention consists of a support collar 12 to which is attached a series of hanger assemblies 14. The support collar assembly 10 can be employed to support, or hang, a particular pot, for example flower pot 20, within any one of a series of larger diameter outer containers, for example, container 16 (see FIG. 1).

Figure 2:
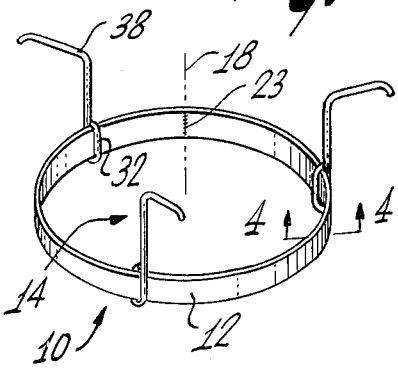
FIG. 2 is a perspective view of the typical support collar assembly shown unattached to any flanged container.

The support collar 12 shown in FIG. 2 has three hanger assemblies 14 attached to it. But the number of hanger assemblies used to support a given flower pot can be varied depending on the weight and size of the inner pot 20 and the diameter of the outer container 16. The generally circular support collar 12 comprises a narrow strap of metal material which, as shown in FIG. 2, is split vertically at section 18 with the resulting end surfaces 22, 23.

The support collar 12 would be secured to the body 21 of flower pot 20 by placing the conically shaped body 21 within the support collar 12, and then urging the support collar 12 vertically along body 21 until collar 12 tightly engages the generally horizontal surface 24 of the outer marginal flange 26 of suspended flower pot 20. In this secured position, the end surfaces 22, 23 of support collar 12 (which should be made of a resilient but high strength material) will either overlap each other, if the support collar 12 is oversized with respect to body 21, or will be slightly spread apart, if the diameter of body 21 adjacent surface 24 is larger than the inside diameter of support collar 12.

Figure 4:
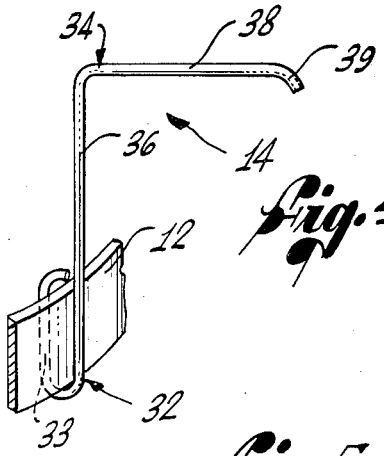
FIG. 4 is an enlarged, detailed, side elevational view, taken along the line 4—4 of FIG. 2, showing a typical hanger assembly in its mounted position on the support collar; and, FIG. 5 is a top view of the support collar assembly, shown in FIG. 2, illustrating the rotative ability of the support arms of the hanger assembly.

FIG. 4 shows an enlarged side elevational view of the preferred embodiment of one hanger assembly 14 attached to a portion of support collar 12. The hanger assembly 14 as shown, comprises a mounting means 32, which is designed to be attached to, support collar 12, and a hanger member 34 integrally connected to mounting means 32. The mounting means 32 is formed, preferably by bending the lower portion of a preferably cylindrical metal rod into an elongated ring portion 33. The remaining portion of the metal rod, called a hanger member 34, comprises, in part, a generally vertical upwardly extending extension arm 36, which is integrally formed with mounting means 32. The support arm 38 extends horizontally from the extension arm 36 and is preferably integrally connected to hanger arm 36.

The support arm 38 is shown bent to a generally horizontal position thereby forming an approximate right angle with hanger arm 36, whereby support arm 38 is cantilevered with respect to the flower pot 20. Support arm 38, the free end of which is turned down into a hook portion 39, is designed to overlie and stably position the inner pot 21 with respect to the upper horizontal surface 40 of the larger outer container 16.

The hanger member 34 in the preferred embodiment is preferably integrally formed with mounting means 32. Alternatively, mounting means 32 and hanger member 34, can be made as separate members and then affixed to each other as by welding, soldering or any other conventional attachment means.

The hanger member or element 34 which has been described as consisting, preferably, of two approximately perpendicular extension and support arms 36, 38, respectively may also be formed in other alternate shapes, without destroying the uniqueness of the invention.

The support collar assembly 10 thus involves novel features of construction consisting of a pivotable hanger assembly 14, adapted to be mounted to an inner container 20, by means of support collar 12, wherein the hanger assembly 14 contains a rotatable cantilever support arm 38 adapted to abut the top horizontal surface 40 of the outer container 16. The hanger assembly 14 thereby provides support for the inner container 2 in combination with stabilizing means in the form of hooked ends on the support arm 38, to thereby stably mount the inner container 20 with respect to the outer container 16.

Figure 3:
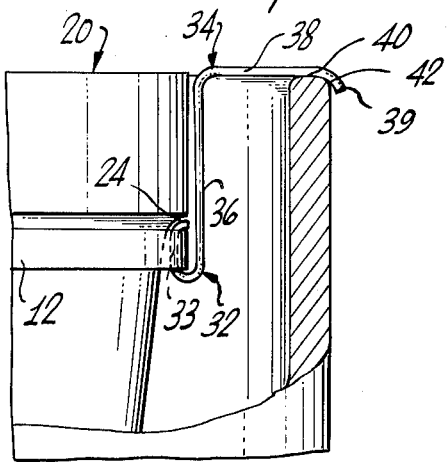
FIG. 3 is a fragmentary side elevational view, partially in section, of the collar support assembly, as it is used when an inner pot is suspended within a larger container, showing the manner in which the support arms of the hanger assembly overlie the lip of the larger container in order to provide stable support for the inner flanged pot.
Figure 5:
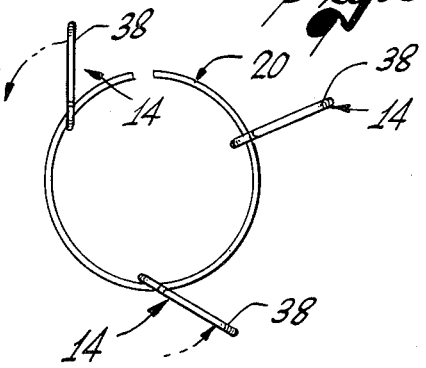

Using either the preferred or alternate embodiments, the hanger element 34 would be capable of being pivoted with respect to the support collar 12, whereby support arm 38 would be free to rotate in a generally horizontal plane. In the preferred embodiment, the hook portion 33 of mounting means 32 is designed to be slightly oversized with respect to support collar 12, thereby enabling the hanger assembly 14 to be rotated approximately 180° with respect to support collar 12 (see FIG. 5). The resulting horizontal motion of the support arm 38 is a unique part of this invention so that the hanger assembly 14 can be adapted to adjust to various sized larger containers by simply rotating the support arms 38 until they overlie surface 40, wherein hook portions 39 thereof can be stably hooked onto the outer upper edge 42 of outer container 16 (see FIG. 3).

Each support arm 38, and each hanger assembly 14 in general, should be made of a high strength material, metal or metal alloy, in order to be capable of stably supporting and suspending flower pots of various weights.

While various embodiments of the invention have been shown and described herein modifications of the invention will be apparent to those skilled in the art. I therefore intend to be bound only by the claims which follow.

I claim:

1. In combination with a container having an outer marginal flange adjacent to the upper edge thereof and having a central vertical axis, a support collar assembly comprising:

a support collar member adaptable to be attached immediately below the flange of said container; and a hanger assembly including a plurality of spaced mounting means each of which are pivotally attached to said support collar member and a plurality of hanger members each of which are affixed to each one of said plurality of mounting means, said hanger members each being rotatable about on an axis generally parallel to said container axis said support collar member in an arc of approximately 180°, said hanger members extending upwardly and outwardly with respect to said support collar member, each said hanger member terminating in a cantilevered support arm having a free end adaptable to be supported on a larger outer container.

2. The support collar assembly of claim 1 wherein said support collar member is formed of a resilient metal and is split vertically at one section so as to insure easy spreadability of said support collar member upon securement to said flanged container.

3. The support collar assembly of claim 1 in which both said mounting means and said hanger members of said hanger assembly are integrally formed from a generally cylindrical rod.

4. The support collar assembly of claim 3 wherein one of said mounting means and one of said hanger members are integral with each other.

5. The support assembly of claim 4 wherein each of said mounting means is loosely fitted with respect to said support collar member whereby each of said mounting means can be moved manually along the circumference of said support collar member.

6. The support collar assembly of claim 1 in which the free end of said cantilevered support arm is provided with a downwardly curved hook portion.

7. The support collar assembly of claim 1 wherein each said mounting means consists of a ring-shaped hook section.

8. The support collar assembly of claim 7 wherein each said ring-shaped hook section is oversized with respect to said support collar member whereby said mounting means is manually movable along the circumference of said support collar member.

9. The support collar assembly of claim 1 wherein each said hanger member has an upwardly extending extension arm and said cantilevered support arm extends approximately at right angles to said extension arm.

10. An article of manufacture, which comprises, in combination:

a container having an outer marginal flange adjacent to the upper edge thereof and having a central vertical axis;

a support collar member attached immediately below the flange of said container; and a hanger assembly including a plurality of spaced mounting means each of which are pivotally attached to said support collar member and a plurality of hanger members each of which are affixed to each one of said plurality of mounting means, said hanger members each being rotatable about on an axis generally parallel to said container axis said support collar member in an arc of approximately 180°; said hanger members extending upwardly and outwardly with respect to said support collar member, each said hanger member terminating in a cantilevered support arm having a free end adaptable to be supported on a larger outer container.

* * * * *